US008820258B2

(12) United States Patent
Bauduin et al.

(10) Patent No.: US 8,820,258 B2
(45) Date of Patent: Sep. 2, 2014

(54) CHAIN CONNECTOR

(71) Applicants: Christian Bauduin, Eze (FR); Jean-Pierre Benoit, Cagnes sur Mer (FR); Jean-Yves Toggiani, Roquebrune Cap Martin (FR)

(72) Inventors: Christian Bauduin, Eze (FR); Jean-Pierre Benoit, Cagnes sur Mer (FR); Jean-Yves Toggiani, Roquebrune Cap Martin (FR)

(73) Assignee: Single Buoy Moorings, Inc, Marly (CH)

( * ) Notice: Subject to any disclaimer, the term of this patent is extended or adjusted under 35 U.S.C. 154(b) by 134 days.

(21) Appl. No.: 13/718,702

(22) Filed: Dec. 18, 2012

(65) Prior Publication Data

US 2014/0165897 A1 Jun. 19, 2014

(51) Int. Cl.
*B63B 21/18* (2006.01)
*B63B 21/08* (2006.01)

(52) U.S. Cl.
CPC ..... *B63B 21/08* (2013.01)
USPC ..... 114/200

(58) Field of Classification Search
USPC ..... 114/200, 230.29, 293, 378
IPC ..... B63B 21/18
See application file for complete search history.

(56) References Cited

U.S. PATENT DOCUMENTS

| | | | | | |
|---|---|---|---|---|---|
| 3,289,626 | A * | 12/1966 | Petrie et al. | ..... | 114/200 |
| 3,859,946 | A * | 1/1975 | Hammerschlag | ..... | 114/200 |
| 5,809,925 | A * | 9/1998 | Montgomery | ..... | 114/200 |
| 5,889,925 | A * | 3/1999 | Tsurutani et al. | ..... | 700/254 |
| 6,663,320 | B1 * | 12/2003 | Braud et al. | ..... | 405/224 |
| 2006/0283368 | A1 * | 12/2006 | Niebur | ..... | 114/200 |

FOREIGN PATENT DOCUMENTS

| | | | |
|---|---|---|---|
| WO | WO2010/112603 A1 | | 7/2010 |
| WO | 2013124717 | * | 8/2013 |

* cited by examiner

*Primary Examiner* — Stephen Avila
(74) *Attorney, Agent, or Firm* — Lawrence S. Cohen

(57) ABSTRACT

A chain connector for holding a chain (14) that moors a vessel to the sea floor under perhaps 2000 tons tension, which can be quickly disconnected in an emergency by applying a moderate disconnecting force such as 50 tons. The chain is hold by ratchets (24, 26) that are mounted on arms (34, 36). The arms have upper ends (35) that am pivotally mounted on a housing (38) and have free lower ends (44), with the lower ends being held by cams (50) on locking dogs (52) that have locking dog lower ends (51) pivotally mounted on the housing and free upper ends (60). A hydraulic actuator (70) has pins (58) that engage the upper ends of the locking dogs to prevent the arms and dogs from pivoting apart until the looking dog upper ends (60) are raised.

3 Claims, 2 Drawing Sheets

CHAIN CONNECTOR

CROSS-REFERENCE

Applicant claims priority from U.S. provisional patent application Ser. No. 61/601,331 filed Feb. 21, 2012.

BACKGROUND OF THE INVENTION

A vessel or other floating body is commonly moored to the sea floor by a chain that passes though a chain connector on the floating body and down to the sea floor. Although a few chains may be used to moor the vessel the tension in each chain may be very high, such as 2000 tons. Previously, tension in the chain had to he reduced before the chain could be disconnected, and large forces were required. The force required to disconnect the chain while it is under tension, should be moderate. Also, the chain connector should be of moderate size. A chain connector of moderate size that allowed emergency disconnection of a chain using only a moderate force, such as no more than 5% of the chain tension for the disconnection, would be of value.

SUMMARY OF THE INVENTION

In accordance with one embodiment of the invention, a chain connector is provided that holds a chain that may be subjected to a very high tension such as 2000 tons, and that allows the chain to be disconnected from a floating body or the like by applying only a moderate release force such 50 tons. The chain extends though a housing and one of its chain links is supported by ratchets The ratchets are mounted on first levers in the form of arms that have upper ends pivotally connected to the chain connector housing and that have free lower ends. The chain connector also has a pair of second levers, or locking dogs, that have lower ends forming earns that hold or release the arm lower ends. The looking dogs have upper ends that are held together by pins. When the pins are raised they release the looking dog upper ends. This allows the locking dog upper ends to move apart, so the cams on the looking dog lower ends release the arms to pivot apart and release the ratchets to release the chain.

The ratchets are pivotally supported on the arms. The ratchets have concave upper ends that receive the convex lower ends of alternate chain links, to distribute the load.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
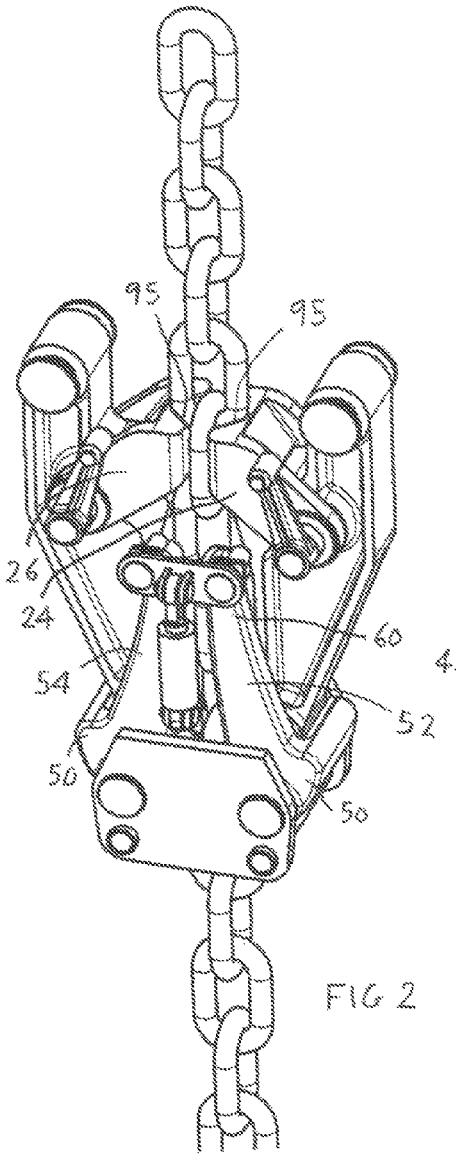
FIG. 2 is an isometric view of the chain connector of FIG. 1, with an upper part of the housing removed for clarity and with the chain supported.
Figure 1:
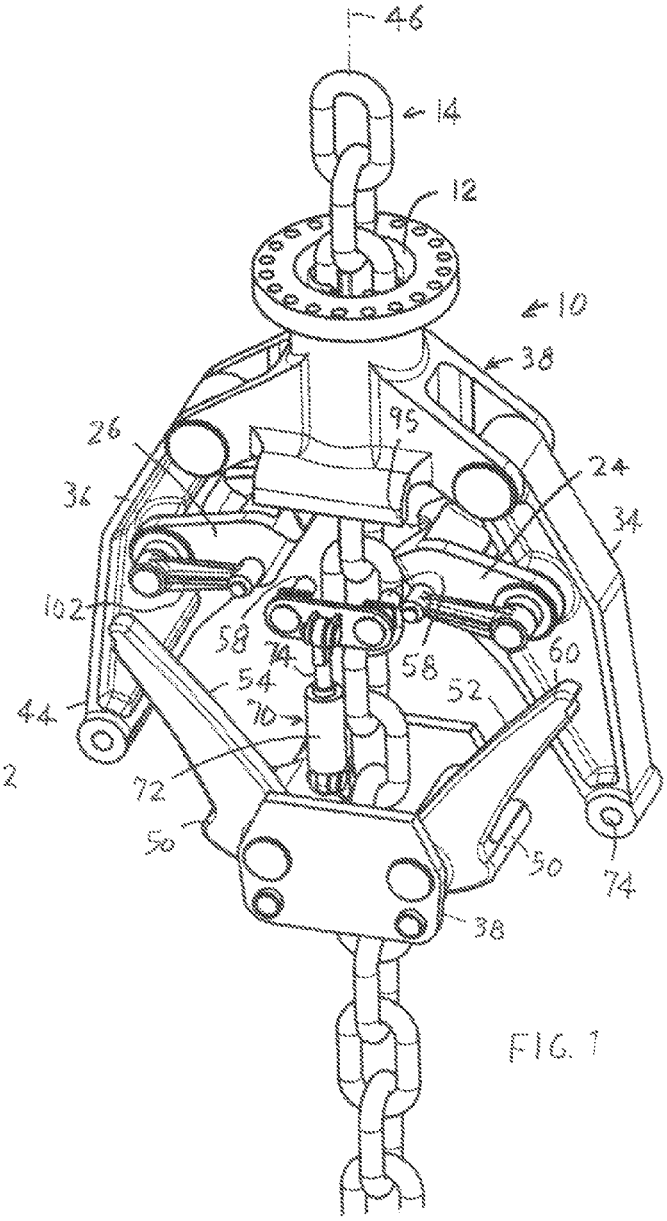
FIG. 1 is an isometric view of a chain connector, with an unsupported chain extending though a passage therein.

FIG. 1 shows a sham connector 10 of the invention which has a passage 12 though which a chain 14 usually expends The chain connector 10 is usually mounted on a floating body such as a vessel, with the chain extending down to the sea floor and anchored thereat to limit drift of the vessel. However, the chain is useful in a variety of applications. Occasionally, the chain must be disconnected from the chain connector, as to allow the replacement of a mooring leg, maintenance, or to allow the vessel to drift or sail away from its moored location, in that case, the chain may be under a high tension such as 2000 tons. The present chain connector is designed to disconnect the tensioned chain from the chain connector using only a moderate force such as 10% of the chain tension for a chain connector of moderate length.

Figure 3:
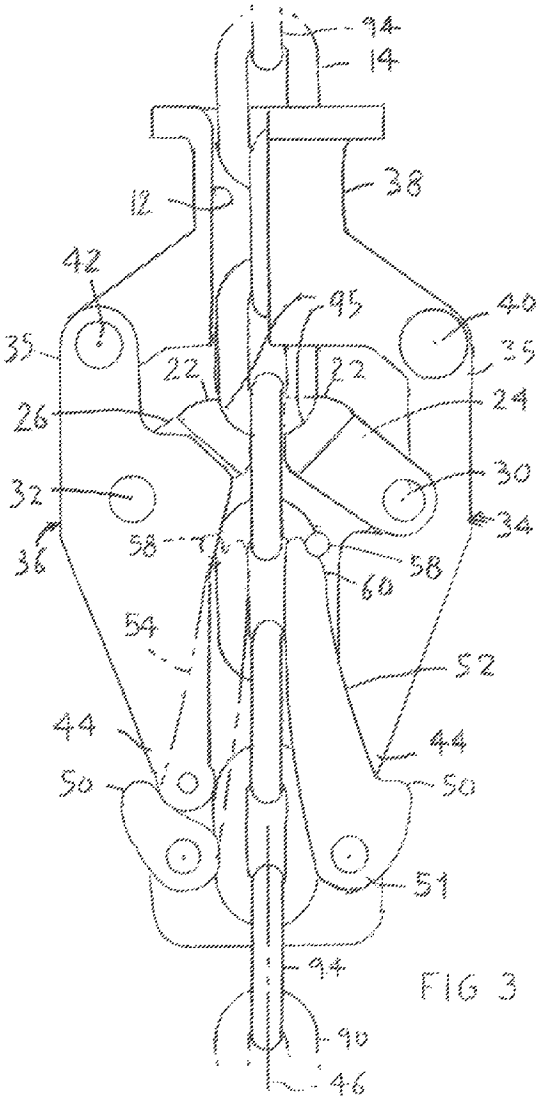
FIG. 3 is a sectional side view of the chain connector of FIG. 1 with the left side of FIG. 3 taken on a centerline of the connector and the right side taken from in front of the locking dogs.

FIG. 3 shows that the chain us supported by upper ends 22 of ratchets 24, 26. The ratchets are pivotally mounted about axes 30, 32 on arms 34, 36. The arms have upper ends 35 pivotally mounted on the chain connector housing 38, about axes 40, 42. The arms have lower ends 44 that are prevented from moving away from a connector axis 46 by cams 50 that are formed on locking dogs 52, 54 (FIG. 1). The locking dogs each has a lower end that forms a cam 50 and has an upper end 60. When a pin 56,58 is moved up and away from the upper ends 60 of the locking dogs, then the locking dog upper ends are free to move apart to the positions shown in FIG 1. As the locking dogs move apart, their cams 50 release the arms 34, 36 and the arms also move apart. Movement of the arms away from each other, to the position of FIG. 1, moves the ratchets 24, 26 away from the chain so the chain is free to move down though the housing passage 12.

The disconnection process is performed by energizing an actuating device, preferably an hydraulic jack 70 (FIG. 1) which has a cylinder 72 mounted on the housing and a piston 74 that can be forcefully moved up. The upper end of the piston holds two pins 58. As shown in FIG. 3 each pin 58, lies against the upper end 60 of one of the locking dogs 52, 54.

The combinations of arms and locking dogs enable the chain to be released by using only a moderate force such as an upward force of 50 tons applied by the jack 70. Instead of using the arms 34,36 combined with the locking dogs 52, 54, it would be possible to use very long arms. However, it is important to minimize the size of the chain connector and the presence of the locking dogs limits the height of the chain connector. The fact that the chain can be released while under high tension allows a release without first reducing chain tension.

Figure 5:
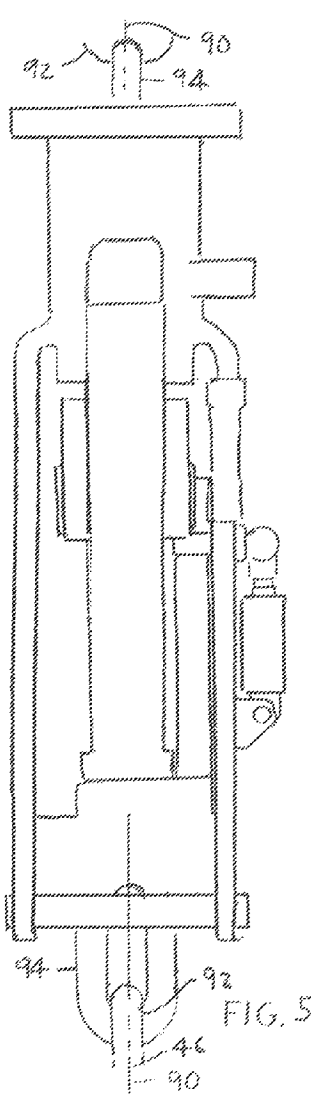
FIG. 5 is a side view of the chain connector of FIG. 4.
Figure 4:
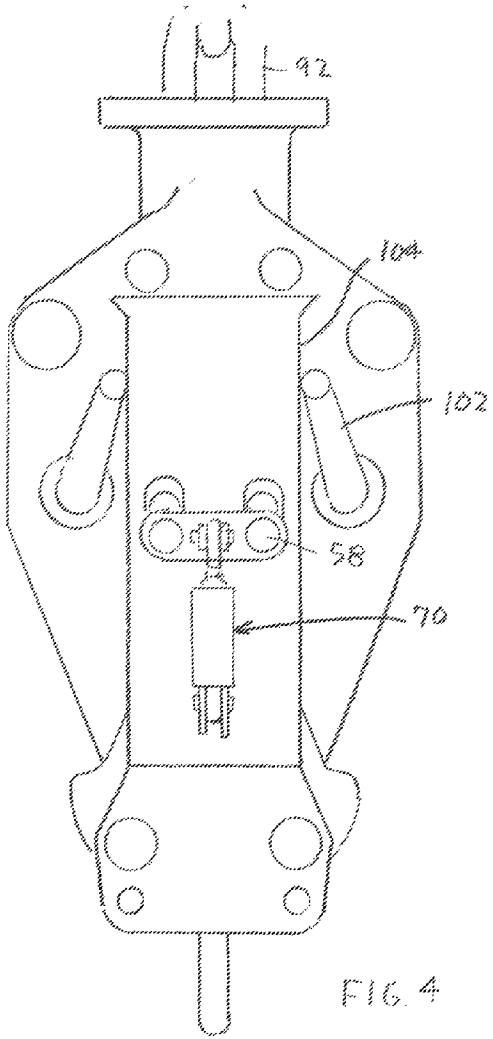
FIG. 4 is a front elevation view of the chain connector of FIG. 3.

The housing has a center plane 90 (FIG. 5) and the chain has aligned links such as 92 that are widest along me center plane and has alternate perpendicular links such as 94 that are widest along a plane that is perpendicular to the center plane. The ratchets (FIG. 3) have concave upper faces 95 that are curved about two axes to distribute the downward force of a chain link over a wide area. The ratchets engage only the aligned links 92. The ratchets are pivoted to move against and away from the chain by the aligned chain links 92 pushing below the ratchets when polling on the chain. Levers 102 that engage housing surface 104, are pivotally mounted on the arms and help control arm position.

Thus, the invention provides a chain connector that enables its disconnection from a chain that is under a high tension (on the order of magnitude of 2000 tons), by applying only a moderate force that is less than 10% and preferably less than 5% of the chain tension. The chain connector includes ratchets mounted on arms that have upper ends pivotally mounted on the control housing. The lower ends of the arms are held against pivoting apart by cams that are located on locking dogs. The locking dogs nave upper ends that are held close to the housing axis by pins on a jack. The jack can be operated to raise the pins out of engagement with the locking dogs to allow the arms and dogs to pivot apart and thereby release the chain.

Thus, the invention provides a chain connector of moderate size, which can disconnect from a chain while the chain is under high tension. The connector includes arms with upper ends that am pivotally mounted on the housing and with free lower arm ends. The connector also includes locking dogs with lower ends that are pivotally mounted on the housing and with free upper ends. The lower ends of the locking dogs form cams that release the arm free lower ends to pivot apart when the dog upper ends are released to move apart. Ratchets that engage the links have upper faces that are curved about two perpendicular axes to provide large area engagement with the links.

Although particular embodiments of the invention have been described and illustrated herein, it is recognized that modifications and variations may readily occur to those skilled m the art, and consequently, it is intended that the claims be interpreted to cover such modifications and equivalents.

What is claimed is:

1. A chain connector comprising:

a housing (36) that has at least a partially vertical chain passage (12) through which a chain extends;

a pair of arms (34, 36) each having an upper end (34) pivotally mounted on said housing about a different arm axis (40, 42), each arm having a lower end (44);

a pair of ratchets (24, 26) each coupled to one of said arms, said ratchets each being engageable with said chain to support the chain and each ratchet being disengageable from said chain to release it;

a pair of locking dogs (52), each having a lower end (44) pivotally mounted on said housing and each dog having a free upper end (60), each dog forming a cam (50) that engages the lower end of one of said arms so when the dog upper ends are released to move apart they release the arm lower ends to move apart;

an activation device (70) mounted on said housing, said device having a pair of pins (58) that each engages one of said locking dog upper ends to prevent said locking dog upper ends from pivoting apart, said activation device being moveable to release said locking dog upper ends.

2. The chain connector described in claim 1 wherein:

said body has a center plane (90) and said looking dogs move in said center plane when said dogs pivot, and said chain has alternate aligned links (92) and perpendicular links (95);

a portion of said chain that lies in said chain passage has aligned links that lie in said center plane;

each of said ratchets has a concave chain-engaging surface (94) that is curved to make area contact with the lower end of one of said aligned links.

3. The chain connector described in claim 1 wherein:

said activation device includes a hydraulic cylinder (72) mounted on said housing below the height of said locking dog free upper ends, and a piston (74) having a lower portion lying in said cylinder and a vertically slideable upper end, said piston upper end carrying a pair of pins (58) that each lies against one of said dog upper ends (60) when said looking dogs are not pivoted apart, to prevent said locking dogs from pivoting apart until said pins are raised.

* * * * *